US006422859B1

(12) United States Patent
Demetz

(10) Patent No.: US 6,422,859 B1
(45) Date of Patent: Jul. 23, 2002

(54) CIGARETTE LIGHTER WITH CHANGEABLE DISPLAY

(75) Inventor: Werner Demetz, Zurich (CH)

(73) Assignee: Living Picture, Inc., Zurich (CH)

( * ) Notice: Subject to any disclaimer, the term of this patent is extended or adjusted under 35 U.S.C. 154(b) by 0 days.

(21) Appl. No.: 09/657,298

(22) Filed: Sep. 7, 2000

(51) Int. Cl.[7] ..... F23Q 2/32
(52) U.S. Cl. ..... 431/126; 431/253; 40/454
(58) Field of Search ..... 431/126, 253, 431/153; 40/454, 453, 466, 470, 436, 373, 622

(56) References Cited

U.S. PATENT DOCUMENTS 2,815,310 A 12/1957 Anderson
4,073,612 A * 2/1978 Nitta ..... 431/126
4,240,783 A * 12/1980 Nevin ..... 431/253
4,935,335 A 6/1990 Fotland
5,104,313 A 4/1992 Zellweger
5,494,445 A * 2/1996 Sekiguchi et al. ..... 40/453
6,093,016 A 7/2000 Lin

FOREIGN PATENT DOCUMENTS

GB 2145804 * 4/1985 ..... 431/253

* cited by examiner

*Primary Examiner*—James C. Yeung
(74) *Attorney, Agent, or Firm*—Malin, Haley & Dimaggio, P.A.

(57) ABSTRACT

A cigarette lighter that includes a lenticular optical indicia display for displaying two or more images on the outside surface of the cigarette lighter body or portions thereof while including an improved non-slip grip.

1 Claim, 2 Drawing Sheets

CIGARETTE LIGHTER WITH CHANGEABLE DISPLAY

BACKGROUND OF THE INVENTION

1. Field of the Invention

The present invention relates to a cigarette lighter such as a small, portable hand-held fluid or gas bearing lighter for lighting cigarettes that includes an exterior display, and specifically to an improved cigarette lighter having at least two changeable images displayed by a lenticular optical display for visually displaying a series of different images.

2. Description of Related Art

Portable cigarette lighters are well known in the prior art. Typically a small portable cigarette lighter is sized to fit in one's hand and has a moveable flint stone, a disposable (non changing flint) or an electronic type device for creating a spark and a source of fuel such as lighter fluid or gas. The fluid is dispersed either on a wick or under pressure as a gas. A manual valve permits gas to be expelled out of an opening at the moment of ignition. Cigarette lighters have often been used also as decorative items such as in creating a cigarette lighter in the shape of a statue as shown in U.S. Pat. No. 6,093,016 issued to Lin. Oftentimes cigarette lighters are also sold or given away for advertising purposes with business names displayed on them and with corporate or club logos as gifts. Corporations have cigarette lighters with the corporate names on them or the corporate logos for forms of advertisements.

The present invention provides for a cigarette lighter that is very useful for advertising and selling into distribution channels (or similar) by having multiple image indicia displays using a lenticular lens array on its outer surface.

Lenticular lenses are well known in the art for use as an optical system to visually display various types of optical images. Lenticular optical systems known in the prior art generally include a transparent sheet having a planer surface on one side, and on the other side a series of parallel, longitudinal convex ridges forming a multiple lenticular system of convex lenses. The image indicia is typically disposed behind the lens on the side having the planar surface. A printed sheet containing a series of spaced image lines constitute the dissection or breakup of a master image. The series of space image lines are optically related with respect to the lenticular lens elements as to be alternately visible upon positional changes of the observer and the observer's line of sight with respect to the lenticular lenses. When viewed from a first position, a first series of image lines are visible and display a first composite image. When viewed from a second position, a second series of image lines are visible and display a second composite image at the same location where the first image was previously viewed. U.S. Pat. No. 2,815,310 issued to Anderson discloses an example of a lenticular optical system.

Further advances in lenticular optical systems have resulted in an increase in the number of observable frames available. The increase in observable frames has made lenticular animation possible. Therefore as the observer's line of sight moves relative to the lenticular viewing screen, a series of pictures come successively into view creating an impression of changes in motion of the images. Currently, lenticular optical technology is capable of producing a composite image of a series of images resulting in an animated picture when viewed continuously at successive viewing angles.

The production of images which change with a change in viewing angles has been known for many years. It is described, for example, by V. G. Anderson in U.S. Pat. No. 2,815,310. The images are produced on opaque or transparent sheets of material such as paper, paper board, or plastic. The resulting inprint, in black and white or color, is laminated to a transparent lenticular lens. Alternatively, a transparent plastic carrier may be printed on a traverse side and viewed through a lenticular lens space of the carrier. In addition technology maybe used to display a wide variety of useful information such as account information, telephone numbers, and email addresses, as examples.

A lenticular screen, as is well known, has a number of lenses arranged in a side-by-side relationship. Each lens, commonly termed a lenticle may be formed by an elongated or circular convex frontal surface, and a flat rear surface.

The printed image is formed by two or more interleaved pictures producing a grid of parallel lines with alternating striations. The pitch, or number of picture-element pairs per unit distance, must be the same as the lens pitch of the lenticular array. In addition, the focal length of each lenticle should be equal to the thickness of the the lenticular sheet. Under these conditions, at one viewing angle an observer would see only one picture, while on a different angle the same observer would see the other picture(s). The requirement that the picture elements be in registration with the lenticular array complicates the printing and lens forming steps.

The focal length of the lenticles must equal the thickness of the lenticular sheet. At a pitch of 100 lenticles per inch, assuming a half cylinder lenticular surface, the focal length for a conventional plastic sheet, having a refractive index of 1.5 to 1.6, is 0.016 to 0.019 inches.

With the present invention, display indicia can provide animation or movement of graphic or alphanumeric information which is used as a form of advertising or information or graphics designs on the surface of a cigarette lighter while still acting as a suitable support handle and grip for the lighter during manual actuation. The lenticular lens aides in the gripping of the lighter surface while the lighter is being held to make the user's hand hold the lighter more efficiently.

Many cigarette and cigar and pipe lighters are made of smooth metal and can be slippery at times, which could be dangerous if the lighter slips while being used to light a cigarette.

With the use of the present invention, a lenticular surface attached to the housing of a cigarette, cigar, or pipe lighter, the housing can be easily held without slipping, creating a non-slip surface from the lenticular grooves while at the same time providing for a multiple image display that can be used for advertising or graphic designs suitable for distribution/resale of the lighter on the lighter of at least two different images at the same location.

BRIEF SUMMARY OF THE INVENTION

A cigarette lighter including a cigarette lighter body sized and shaped much like a tubular or rectangular housing, said cigarette lighter including an ignition and flame device to provide for a flame for lighting a cigarette. The cigarette lighter housing or body may be made of a durable plastic or metal that includes a dual image indicia display affixed to the outer surface of the cigarette lighter body and a lenticular lens array disposed in one embodiment laterally around the outside surface of the lighter body, said lenticular lens being sized and shaped to permit dual image display indicia caused by movement of the lighter body relative to an observer's line of sight to create different images at the same location on the exterior surface of the lighter. The lenticular lens system has a plurality of ridges forming convex lens surfaces separated by grooves. The grooves aid in grasping the lighter body. The cigarette lighter body is encompassed in a lenticular display system that can provide animated images or other useful dual information. The lenticular array is also capable of providing a non slip surface on the outside of the lighter body. Therefore the invention may include at least a portion of the cigarette lighter surface on the housing comprising a transparent lenticular display with images under the lenses forming at least two image displays.

It is an object of the present invention to provide a cigarette lighter that includes a lenticular optical system for at least two different image displays on its outer surface at the same location.

It is another object of the present invention to provide a portable, hand-held cigarette lighter that includes a lenticular optical surface system that allows for the lighter to be gripped in the hand as an non-slipping surface for safety reasons.

At yet still another object of the invention is to provide a lighter with a lenticular display that provides multiple indicia displays for advertising, information, and graphic design purposes.

In accordance with these and other objects which will become apparent hereinafter, the instant invention will now be described with particular reference to the accompanying drawings.

PREFERRED EMBODIMENT OF THE INVENTION

Figure 1:
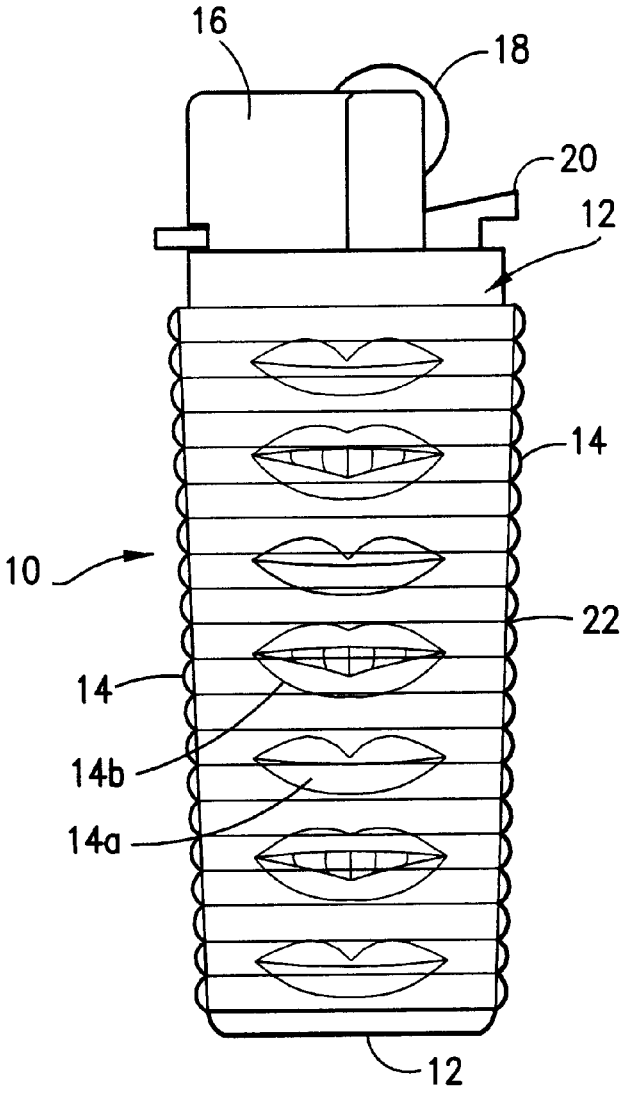
FIG. 1 shows a front elevational view of a cigarette lighter (be it disposable, refillable, changeable flint, electronic or other lighting mechanism) having a lenticular surface showing indicia display.

Preferring now to the drawings, and in particular FIG. 1, the present invention is shown generally at 10 that includes a cigarette lighter body 12 that may be made of a rigid plastic or metal and that includes a cigarette lighter actuating device having an upper housing 16 and a flint stone actuator 18 to create a spark and fuel valve actuator 20 that allows fuel to be dispersed from the lighter. The cigarette lighter operation is known in the prior art and is conventional. The cigarette lighter can be portable, disposable, refillable, changeable flint, electronic or other cigarette, cigar, or pipe lighting mechanism that is hand held. In this case gas stored inside the housing 12 can exit through a valve (not shown) upon the manual depression of the valve actuator 20. Opening the valve allows gas to escape while the spark actuator 18 is rotated creating a spark to ignite the flame.

Figure 2:
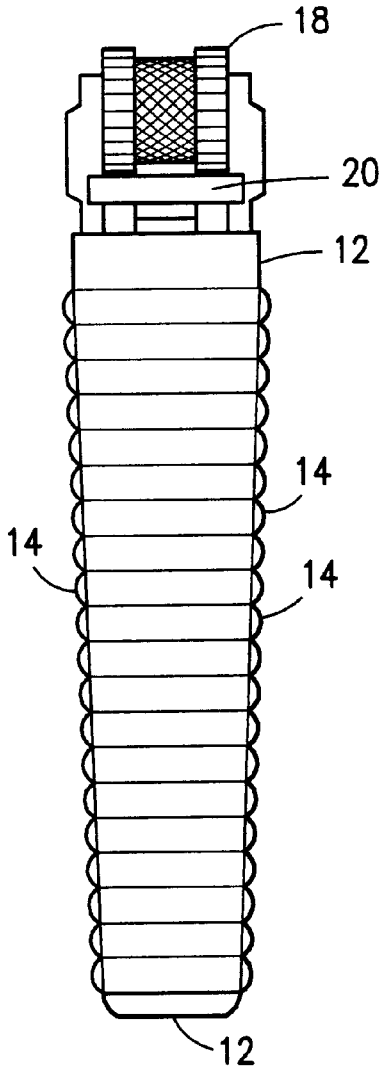
FIG. 2 shows a side elevational view of the cigarette lighter shown in FIG. 1.

The lighter body 12 exterior surface has attached thereto a transparent lenticular lens array 14 that surrounds the body. In the embodiment shown in FIG. 1, the lenticular lens surfaces include parallel grooves that are disposed laterally relative to the longitudinal axis of the lighter (from top to bottom). The grooves 22 extend from side to side around the lighter body 12. The printed indicia images 14*a* and 14*b* are disposed on the lighter body exterior housing surface and as shown include a pair of lips 14*a* that are closed, and a second indicia display showing a pair of open lips with teeth exposed as in 14*b*. As the lighter body 10 is moved relative to the observer's view, the lips will appear to open and close exposing the teeth when opening, and not exposing the teeth when closed. Image 14*a* changes into image 14*b* and vice versa as the lighter body is moved relative to the line of sight. Any type of dual images 14*a* and 14*b* can be affixed to the lighter housing 12 prior to applying the lenticular display 14. Note that the grooves 22 formed by the convex lenticular lenses form a non slip surface and aid in grasping the lighter and holding the lighter, making the lighter safer to operate. The lenticular surface acts as a handle or non-slip grip for the entire lighter 10 for safety reasons. FIG. 2 shows the lenticular surface 14 disposed completely around the entire body of the lighter. All four sides have the lenticular system.

Figure 3:
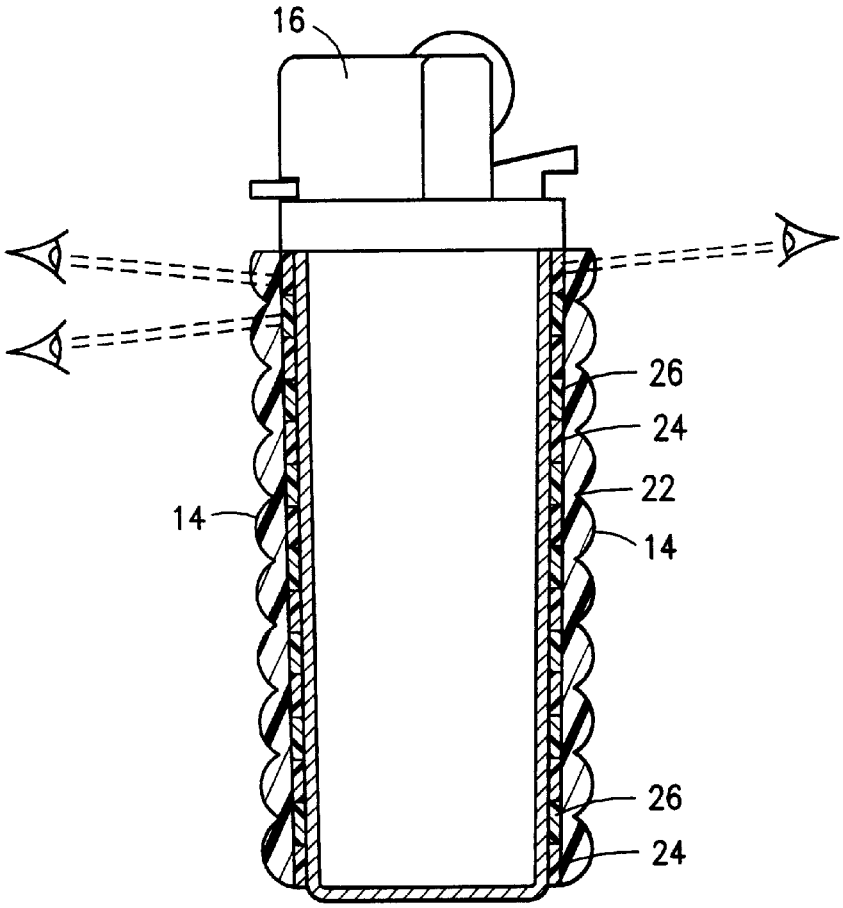
FIG. 3 shows a front elevational view partly in cross section with a lenticular lens array exaggerated in size.

Referring now to FIG. 3, the lighter is shown in cross section with the lighter housing 12 being enlarged and the images 24 and 26 being represented as alternating cross hatched boxes to represent the viewing of a specific image indicia relative to the eye. The convex lenses 14 are formed around the body of the lighter and are spaced apart by grooves 22. Based on the orientation of the observer's eyes, two images are available depending on how the lenticular display is set up. N number of images can be obtained by different relative viewing positions of the viewing angle relative to the convex lens surfaces 14. The lenticular display lenses 14 are transparent making the images 24 and 26 that have been disposed on the outside surface of the lighter body 12 visible. As shown in this example, two images are observable by changing the relative viewing position. One can see image 24 in one position and image 26 in another position at the same general location of the lighter.

Figure 4:
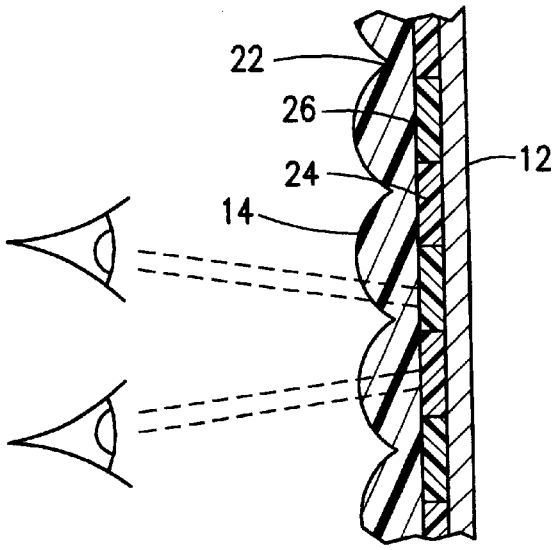
FIG. 4 shows a cut away view in cross section of a lenticular display used with the present invention on a portion of the cigarette lighter housing.

Referring now to FIG. 4, the housing body 12 has affixed thereto images 24 and 26 suitable for creating N number of visual displays in conjunction with the plurality of lenticular display lenses 14 separated by grooves 22. Note that the convex lenses separated by grooves form a series of grooves around the surface of the lighter housing 12 which aids in non-slip gripping of the lighter surface.

As illustrated in FIG. 4 a series of spaced image lines are positioned relative to the lens elements 14 as to be alternately viewable upon positional changes of the observer with respect to the lenses. For example, when viewed from a first observation position, the first series of image lines 24 are visible and form one composite image. Specifically when viewed from one observation position, the optical lines are sighted and refracted by convex lenses 14 toward the first image line so that the observer sees a coherent and comprehensive image corresponding to the image represented by first image lines 24. As shown in FIG. 1, a series of images are displayed. On the other hand when viewed from a second observation position, a series of different image lines are visible and display a second composite image 26. In this case, the observer will see either an open set of lips showing teeth or closed set of lips. So when viewed from a different observational positions, the optical lines are refracted by the convex lenses 14 toward the second image lines so that the observer sees a coherent and comprehensive image corresponding to the image represented by the second image lines. Thus two separate images are viewable from different view points at the same locations on the lighter surface.

As previously discussed, advances in lenticular optical systems have resulted in an increasing number images that are available for use with lenticular lenses. The increase and observable image set has made lenticular animation possible. Therefore as the observer views relative to the lenticular viewing screen, a series of pictures come successively in view creating the impression of continuous changes in the phases of motion. To the extent the disclosure and diagrammatic representation shown herein may be limited to first and second image sets, the present invention contemplates use of a large number of observer image sets, particularly a sufficient number of N sets to achieve animation images where desired.

The invention also requires that the lenticular lenses be disposed on the outside surface of the cigarette lighter body in order to create a non-slip surface 10 aid in holding and grasping of the cigarette lighter especially during operation for safety reasons.

In an alternate embodiment, the indicia display may be opaque still permitting the grasping of the surface of the lighter housing without an indicia display. Also the lenticular screen could run vertically.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable, hand-held cigarette lighter comprising:

a cigarette lighter body, sized to be hand-held;

a flame fuel source connected to said lighter body;

a flame ignition device connected to said lighter body and positioned relative to said flame fuel source for providing a cigarette lighter that creates a flame for lighting a cigarette; and means connected to said cigarette lighter body and wrapped around the exterior of the cigarette lighter body for gripping said cigarette lighter body, said means for gripping including a lenticular display providing two separately viewable images dependent upon a viewer's line of sight, including a first lenticular image and a different second lenticular image, said lenticular display disposed on the exterior surface of said lighter body, said lenticular display including a lenticular lens array comprising a plurality of convex lenses separated by substantially parallel grooves, said convex lenses disposed around said cigarette lighter body and said substantially parallel convex lenses' grooves laterally disposed relative to the longitudinal axis of said cigarette lighter body, said first image including first indicia connected to said lighter body and said second image including second indicia connected to said lighter body, said lenticular lens array including said first and second images providing at least two separately viewable images.

* * * * *